US005188301A

United States Patent [19]

Hasegawa

[11] Patent Number: 5,188,301

[45] Date of Patent: Feb. 23, 1993

[54] DISPOSAL DEVICE FOR PAPER DOCUMENTS

[75] Inventor: Takanori Hasegawa, Tokyo, Japan

[73] Assignee: Riso Kagaku Corporation, Tokyo, Japan

[21] Appl. No.: 850,132

[22] Filed: Mar. 12, 1992

[30] Foreign Application Priority Data

Mar. 13, 1991 [JP] Japan ..... 3-48456
Feb. 7, 1992 [JP] Japan ..... 4-22325

[51] Int. Cl.[5] ..... B02C 7/14

[52] U.S. Cl. ..... 241/33; 241/100; 241/236

[58] Field of Search ..... 241/33, 100, 101.2, 241/236; 335/308, 133, 316

[56] References Cited

U.S. PATENT DOCUMENTS 4,709,197 11/1987 Goldhammer et al. ..... 241/236 X
4,889,290 12/1989 Koffsky et al. ..... 241/100 X
5,039,020 8/1991 Leuthold et al. ..... 241/236 X

FOREIGN PATENT DOCUMENTS 0281136 7/1988 European Pat. Off. .
92302174 7/1992 European Pat. Off. .
2204141 11/1988 United Kingdom .
2209963 1/1989 United Kingdom .

*Primary Examiner*—Douglas D. Watts
*Attorney, Agent, or Firm*—Dickstein, Shapiro & Morin

[57] ABSTRACT

In the disposal device for paper documents according to the present invention, the feeding of paper that is to be disposed can be done either automatically with a feeding unit or manually from a manual inlet. Therefore, the disposal of sensitive paper documents can be carried out sheet by sheet by placing the paper on the automatic paper feed unit while paper documents which do not require any security measures may be manually fed into the disposal device for an immediate shredding process. Therefore, the present invention allows both appropriate and efficient disposal of paper documents without regard to whether the paper documents to be disposed require security measures or not.

2 Claims, 8 Drawing Sheets

FIG. 4

```
file list

1. 92-01-10  10:00  reports       5 pages
2. 92-01-11  15:00  instructions  1 page
```

DISPOSAL DEVICE FOR PAPER DOCUMENTS

TECHNICAL FIELD

The present invention relates to a disposal device for paper and other information carrying media (which is referred to simply as "paper" hereinafter), and in particular to a disposal device for shredding paper and other information carrying media for the purpose of ensuring the security of the information.

BACKGROUND OF THE INVENTION

The devices for shredding paper documents for information security purpose are known as paper shredders, and are widely used for the disposal of paper documents containing sensitive information.

A paper shredder ensures the security of information by shredding paper documents finely enough for the information contained in the paper documents to be illegible, and recovery and reconstruction of information from shredded paper documents are practically impossible.

In the light of this possible inconvenience, it has been proposed to read the information in the paper documents with an image scanner or the like before they are shredded or otherwise destroyed so that the information read out from the paper documents may be retrieved when required.

Such a device is desired to be equipped with paper feed means for feeding each sheet of paper from a stack of paper placed on a paper feed table for efficient handling of a large number of paper sheets.

Some of the paper documents may not contain any sensitive material and the information contained in such paper documents may not be required to be retained in storage means. Therefore, it is preferable to shred such documents by a number of sheets at a time instead of processing the documents sheet by sheet according to the capability of the paper shredder from the view point of the efficiency of the device operation.

BRIEF SUMMARY OF THE INVENTION

In view of such recognitions by the inventor, a primary object of the present invention is to provide a disposal device for paper information which can process paper documents efficiently and appropriately without regard to whether they require security precautions or not.

This and other objects of the present invention can be accomplished by providing a device for disposing paper and other information carrying media, comprising: means for feeding paper individually for each sheet; information read out means for reading information carried by each sheet of paper fed by the paper feeding means; information storage means for storing the information obtained by the information read out means so as to be reproduced as required; paper shredding means for shredding the paper after the information is read therefrom; and a manual inlet for feeding paper directly into the paper shredding means.

Thus, the paper to be disposed may be fed into the paper shredding means either automatically from the paper feeding means or manually from the manual inlet, so that paper from which information is required to be read out can be fed by the paper feeding means while paper which does not require any such security measures may be simply fed into the manual inlet. Therefore, the operation efficiency of the disposal device is substantially improved.

According to a preferred embodiment of the present invention, the paper shredding means consists of an existing paper shredder, and an essential part of the present invention may be constructed and marketed as an attachment which may be fitted onto an existing paper shredder.

BRIEF DESCRIPTION OF THE DRAWINGS

Now the present invention is described in the following with reference to the appended drawings, in which:

FIG. 4 is an example of a file list displayed on the display unit of the disposal system for paper documents according to the present invention;

DETAILED DESCRIPTION OF THE PREFERRED EMBODIMENTS

Figure 1:
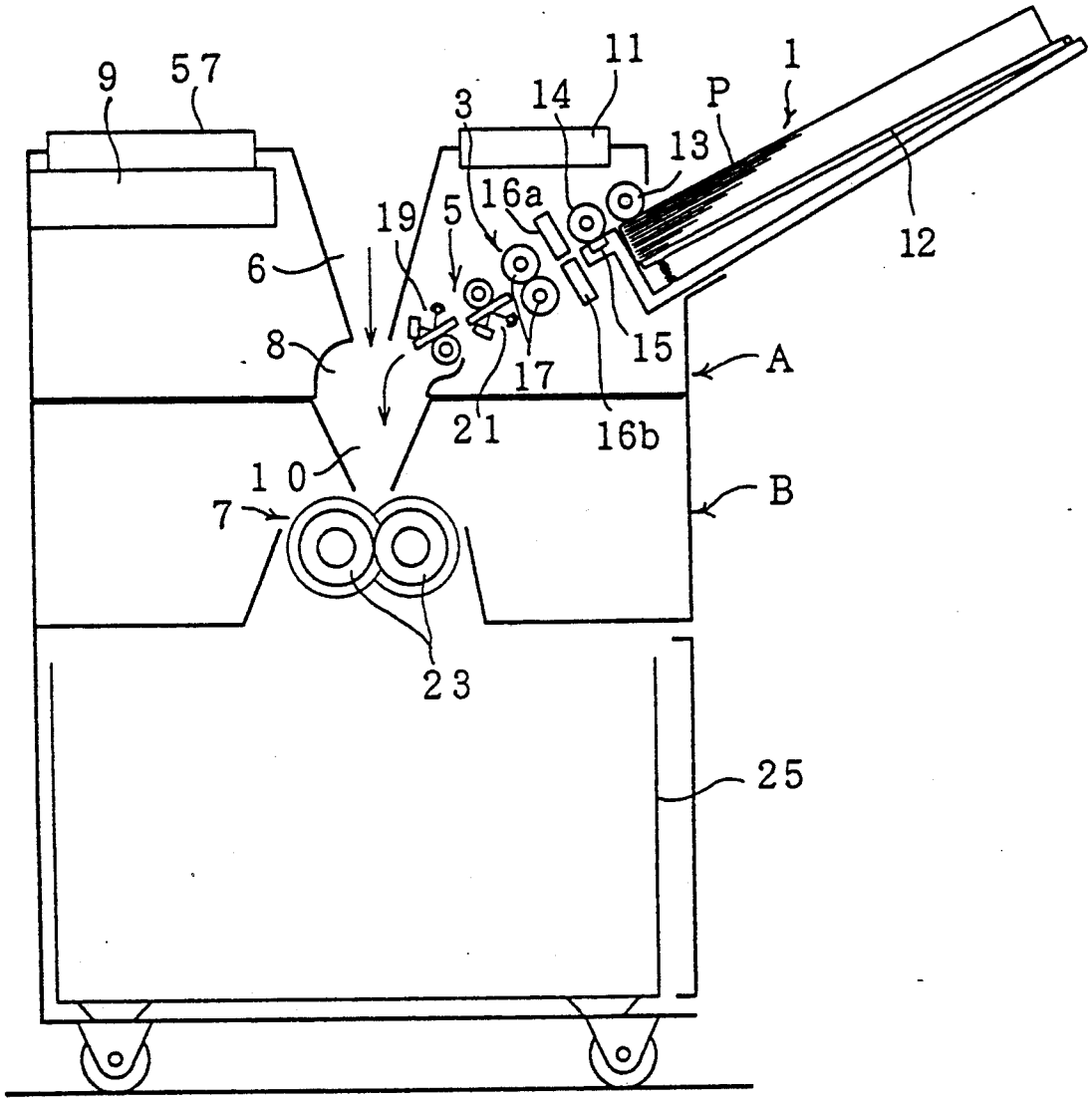
FIG. 1 is a diagram showing the overall structure of an embodiment of the disposal device for paper documents according to the present invention.

Referring to FIG. 1 showing an embodiment of the disposal device for information carrying media such paper documents, this device comprises an automatic paper feed unit 1, a paper feed roller unit 3, an information read out unit 5, a paper shredding unit 7, an information processing unit 9, and an operation panel unit 11. The automatic paper feed unit 1, the paper feed roller unit 3, the information read out unit 5, and the information processing unit 9 are provided inside an upper housing A while the paper shredding unit 7 is provided inside a lower housing B. In this embodiment, the upper and lower housings A and B can be separated from each other.

The automatic paper feed unit 1 comprises a paper feed table 12 located on the front end of the upper housing A, a paper feed roller 13 for feeding the paper P placed on the paper feed table 12, and a paper separating roller 14 and a friction pad member 16 which are arranged opposite to each other at an inlet end of the automatic paper feeding unit 1, and even when two sheets of the paper P are fed from the paper feed table 12, only the upper sheet may be fed out to the paper feed roller unit 3 by preventing the feeding of the lower sheet by making use of the difference of the friction between the paper separation roller 14 and the paper sheet P from that between the friction pad member 16 and the paper sheet.

A light emitting element **16*a* and a light receiving element 16*b* are placed opposite to each other at a laterally central part of the inlet end of the automatic paper feeding unit 1 on upper and lower sides of the path for feeding paper P, and the passage of each sheet of paper, the count of the number of the paper sheets that have been fed, and the occurrence of double feed can be detected according to the change in the amount of light received the light receiving element 81 by each of the paper sheets passing between the light emitting element 79 and the light receiving element 81**, and obstructing the transmission of light therebetween.

Detection of a faulty double feeding of the paper or detection of the occurrence of feeding two sheets of paper at a time according to the amount of the light received by the light receiving element 16*a* may be accomplished by detecting the changes in the amount of light passed through a single sheet of paper and two sheets of paper, and a detection circuit for the light receiving element 16*a* stores a threshold level which corresponds to the amount of light that is passed through a single sheet of paper so that the occurrence of double feeding of the paper may be detected by the reduction of the light received by the light receiving element 16*a* below the threshold level. When a double feeding of paper is detected, the feeding of the paper P is interrupted, and an error display and an alarm are activated as an error process.

The paper feed roller unit 3 comprises a pair of paper feed rollers 17 which are driven at a prescribed rotational speed, and each sheet of paper P from the automatic paper feed unit 1 is fed to the information read out unit 5 at a prescribed feed speed.

The information read out unit 5 comprises a CCD line sensor 19 for the front side serving as first information reading means, and another CCD line sensor 21 for the back side serving as second information reading means. The front side CCD line sensor 19 is fixedly placed in such a position as to scan the information printed on the front face or, in the illustrated embodiment, the upper side of the paper P fed by the paper feed roller unit 3, and the back side CCD line sensor 21 is fixedly placed in such a position as to read the information printed on the back face or, in the illustrated embodiment, the underside of the paper P fed by the paper feed roller unit 3.

The upper housing A is provided with an inlet 6 (which is referred to as "manual inlet" hereinafter) for manually feeding paper into the disposal device. The manual inlet 6 opens from an upper face of the upper housing A, and is provided with a hopper-like lower part which opens into a converging section 8. The converging section 8 opens into a bottom end of the upper housing A so that the paper from both the information read out unit 5 and the manual inlet 6 may be guided to a lower opening at the bottom end of the upper housing A.

The upper end of the lower housing B is provided with a shredder inlet 10 which opens at the upper end of the lower housing B in alignment with the converging section 8, and opens into the paper shredding unit 7 at its lower end.

A shredded paper storage box 25 is provided removably under the paper shredding unit 7 so that the shredded paper pieces produced from the paper shredding unit 7 may be received therein.

Figure 2:
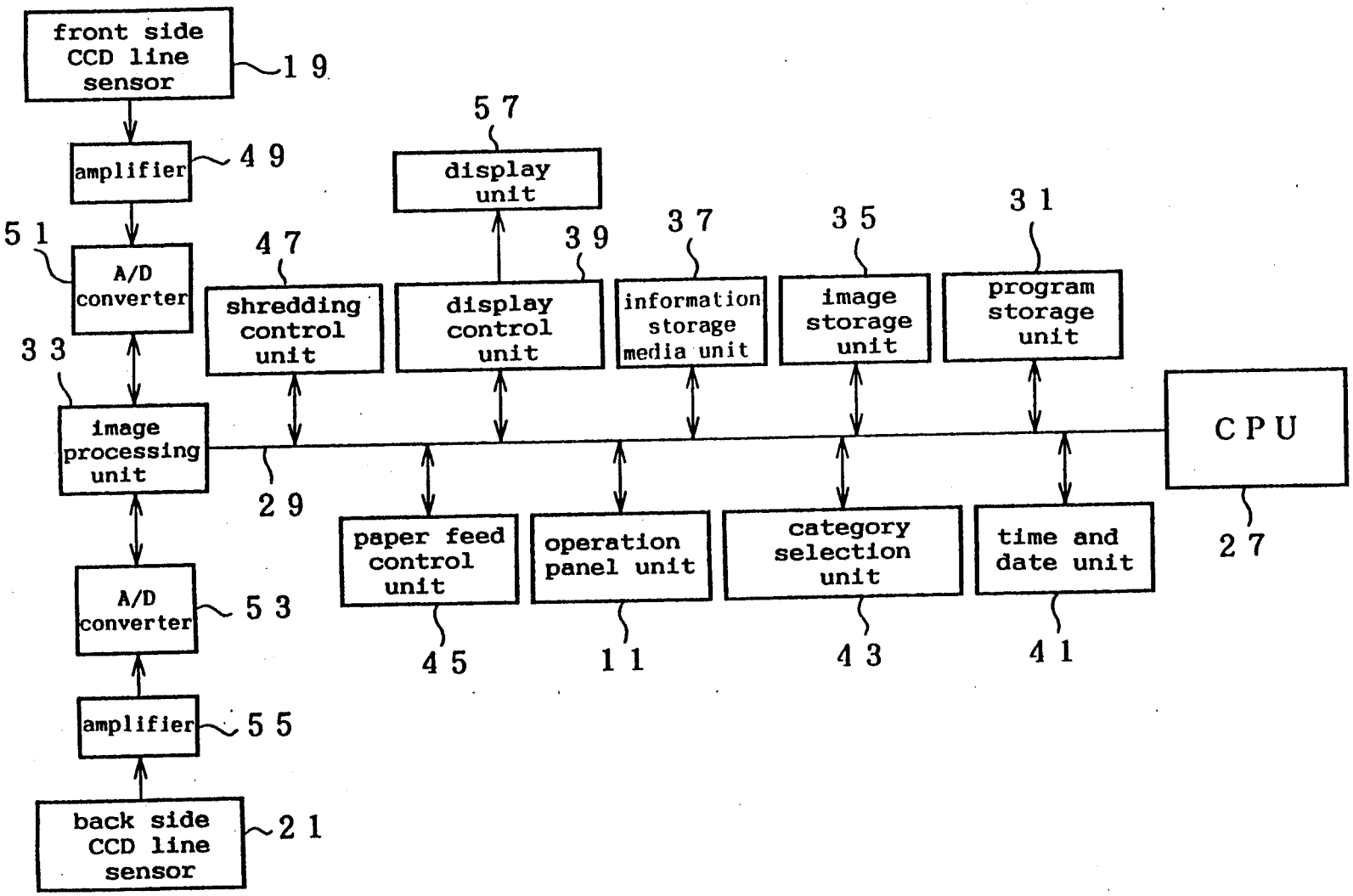
FIG. 2 is a block diagram showing an embodiment of the control system for the disposal system for paper documents according to the present invention.

Referring to FIG. 2, the information processing unit 9 is operated by a computer including a CPU 27, and comprises a program storage unit 31, an image processing unit 33, an image storage unit 35, an information storage media unit 37, a display control unit 39, a time and date unit, an information category data unit 43, a paper feed control unit 45 for controlling the operation of the automatic paper feed unit 1, and a shredding control unit 47 for controlling the operation of the paper shredding unit 7 which are connected to each other via a bus line 29. Further, the information processing unit 9 electrically connects the bus line 29 to the operation panel unit 11.

The front side CCD line sensor 19 and the back side CCD line 21 read the information printed on each sheet of paper P as image information, and convert it into an electric signal. The electric signal produced by the front side CCD line sensor 19 is amplified by an amplifier 49, and is converted into a digital signal by an A/D converter 51. The electric signal produced by the back side CCD line sensor 21 is amplified by an amplifier 53, and is converted into a digital signal by an A/D converter 55. These digital signals are fed into the image processing unit 33.

The image processing unit 33 carries out the processes of compensating and compressing the digital image signal from the A/D converters 49 and 53 under the command from the CPU 27, and the obtained data is stored in the image storage unit 35 for each sheet of the paper P.

The image storage unit 35 is a buffer memory for storing the image data for each sheet of paper P, and comprises a memory area for the information read out by the front side CCD line sensor 19 or the information read out from the front side of the paper sheet, and another memory area for the information read out by the back side CCD line sensor 21 or the information read out from the back side of the paper sheet, separately from each other. Once image data for one sheet of the paper P is stored in each of the memory area, this image data is transferred to the information storage media unit 7 under the command from the CPU 27.

The information storage media unit 37 is an external storage device which writes image data into an optical disk, a flexible magnetic disk, magnetic tape or other storage media as a file. Each file may be assigned with a serial number in the order of creation, for the convenience of retrieval.

The display control unit 39 carries out the control required for the display of information for the purposes of checking the contents of the read-out data, and reproducing the image data written into the information storage media unit 37, and is connected to a display unit 57 such as an LCD panel mounted on the top face of the upper housing A.

The time and date unit 41 is a calendar/timer, and produces data on the current date and time under the command from the CPU 27, and the data on the current date and time produced by the time and date unit 41 is automatically time stamped on each of the files as information on the date and time of creation when storing image data obtained by the read-out process into the information storage media unit 37 as a file.

Figure 3:
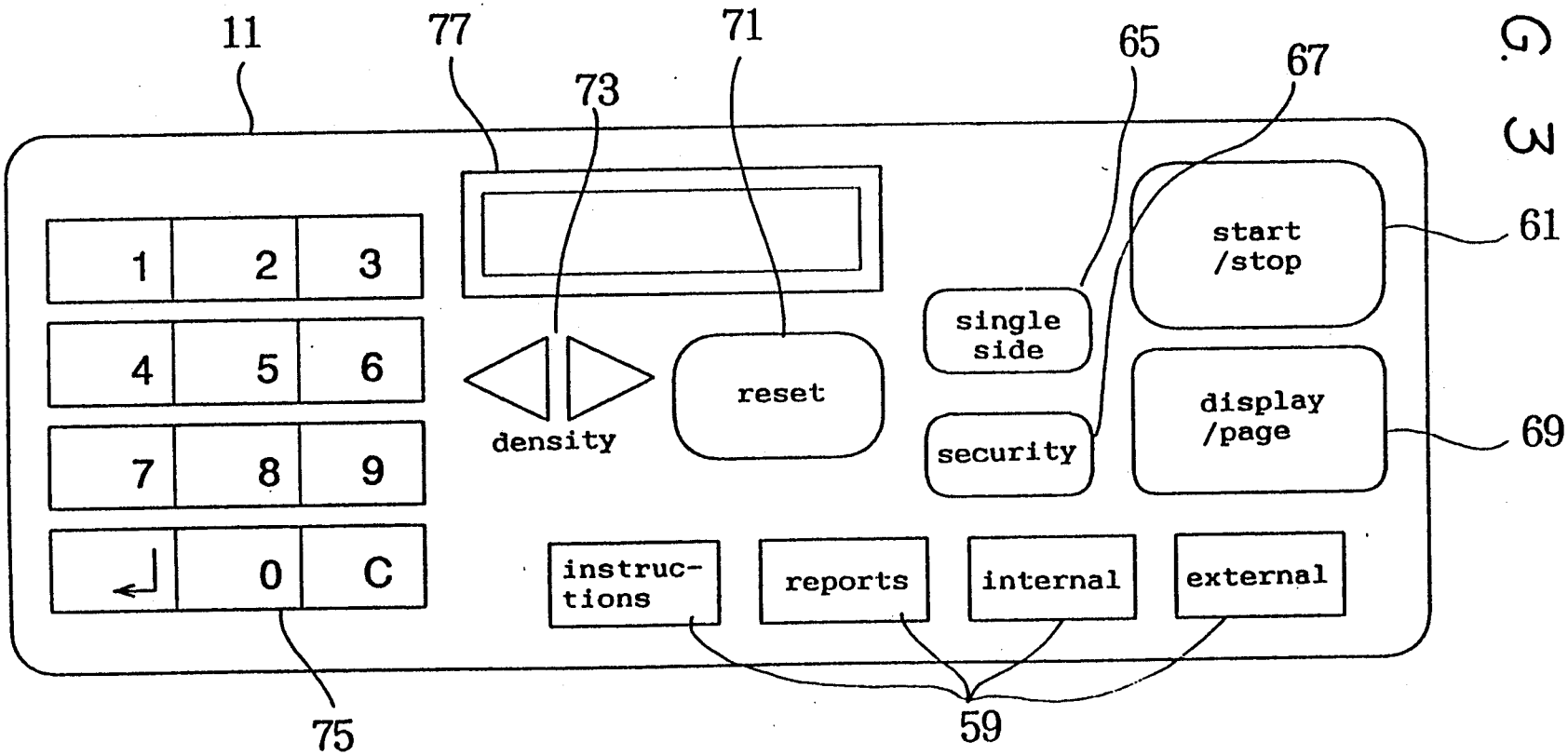
FIG. 3 is an embodiment of the operation panel of the disposal system for paper documents according to the present invention.

The information category data unit 43 stores different codes for different categories of documents which are expected to be created during normal course of work, such as "reports", "instructions", "internal materials" and "external materials", and the operator can select each category by pressing one of category selection keys 59 provided in the operation panel 11 as illustrated in FIG. 3. The data on the selected category of documents is automatically attached to the file when storing the data read out from the paper sheet that is to be shredded along with the data on the date and time of creation.

Referring to FIG. 3, the operation panel 11 comprises, in addition to the category selection keys 59, a start/stop key 61, a single-side mode selection key 65, a security mode selection key 67, a display mode selection/next page key 69, a reset key 71 for resetting various conditions, a density adjustment key 73 for adjustment for different density of the paper sheet to be read out, a ten-key pad 75 for entering a password in case of a security mode and designating the file that is to be displayed, and an LCD panel 77 for displaying the set-up conditions, and the signals from these keys are supplied to the information processing unit 9.

Now the operation of the disposal device for paper documents according to the present invention is described in the following.

When the power is turned on, the double-side read-out mode is automatically set up by default, and a stack of paper documents that is to be disposed is placed on the paper feed table 12 of the automatic paper feeding unit 1 with is first page facing up on top of the stack. If necessary, one of the category selection keys 59 may be pressed according to the category of the documents that are to be disposed, and the start/stop key 61 is pressed.

This causes the paper P on the paper feed table 12 to be fed to the paper feed roller unit 3 sheet by sheet, and then fed into the information read-out unit 5 again sheet by sheet. At this time point, the front side CCD line sensor 19 and the back side CCD line sensor 21 are both ready for read-out, and the front side CCD line sensor 19 scans the information printed on the front side of the sheet of paper P passing in front of (below in FIG. 1) the CCD line sensor 19 at a prescribed speed, and the back side CCD line sensor 19 scans the information printed on the back side of the sheet of paper P passing in front of (above in FIG. 1) the CCD line sensor 19 at a prescribed speed. Thus, the two sides of the paper part read by the device.

Referring to FIG. 2, the electric signal produced by the front side CCD line sensor 19 is amplified by the amplifier 49, and is converted into a digital signal by the A/D converter 51. Likewise, the electric signal produced by the back side CCD lines sensor 21 is amplified by the amplifier 53, and is converted into a digital signal by the A/D converter 55. The digital signals thus obtained are supplied to the image processing unit 33 which carries out compensation and compression processes on these signals, and are stored in the image storage unit 35 for each sheet of the paper P.

After the image data of the front side of the paper and the image data of the back side of the paper are stored in the corresponding memory areas of the image storage unit 35, the image data on the front and back sides of the paper P is transferred to the information storage media unit 37 in a prescribed order, and written into the memory medium.

When there is no information printed on the front and back sides of the paper sheet P, and the read-out image data is totally blank, there is no need to transfer the image data of this particular sheet, and this finding is transferred to the information storage media unit 37 to be recorded as such in the information storage media unit 37.

The writing of the image data into the recording medium of the information storage media unit 37 is carried out so that a single unit of documents are handled as a single file which is accompanied by data on the date and time of creation generated by the date and time unit 41, and the document category data generated by the category data unit 43 so that this data may be written into the recording medium of the information storage media unit 37 along with the image data, and may be read out as desired.

After being passed through the information read out unit 5 and read out thereby, the paper p is fed into the paper shredding unit 7, and is shredded finely enough to be illegible and dropped into the shredded paper storage box 25.

When a security measure is required in discarding the shredded paper, the security mode selection key 67 is pressed before the start/stop key 61 is pressed. In this case, a security mode is set up, and a password is prompted to be entered. When the necessary password is entered as an entry of a plurality of digits from the ten-key pad 75, the read-out process may be started by pressing the start/stop key 61.

When only one side or the front side of the paper P is required to be read, the single-side mode selection key 65 is pressed before the start/stop key 61 is pressed, and only the front side CCD line sensor 19 is activated for the read-out process. Alternatively, it is possible to activate only the back side CCD line sensor 21 when the single-side mode is selected.

When the information printed on the paper P is not required to be stored, the paper P is manually fed into the manual inlet 6 by several sheets at a time if there are a number of sheets of paper to be disposed. The paper inserted into the manual inlet 6 passes through the converging section 8, and reaches the inlet to the shredding unit 10 and then to the paper shredding unit 10. The paper P which is introduced into the paper shredding unit 7 is shredded into sufficiently small pieces to make them illegible with cutter rotors 23, and the shredded paper pieces are received in the shredded paper piece storage box 25.

The paper P may be inserted from the manual inlet 6 even while paper documents containing information to be stored are being fed into the device from the paper feed roller unit 3, and the present embodiment thus allows shredding of paper documents not requiring security measures while processing paper documents that require security measures as an interruption process.

When the image data stored in the storage medium of the information storage media unit 37 for each document as a file is to be reproduced, the display mode selection/next page key 69 is pressed. This sets up the display mode for the image data, and a list of the files stored in the storage medium of the information storage media unit 37 is displayed on the display unit 57 as illustrated in FIG. 4. This list contains only those files which are not assigned with a password for security purpose. To list those assigned with a password, it is necessary to press the security mode selection key 67 and to enter the password from the ten-key pad 75. In this case, if the entered password matches up with the password assigned to the file, the list of the files associated with this password is displayed on the display unit 57.

This file list contains the serial number, the data and time of creation, the category and the number of pages for each file, and the file to be displayed may be selected by entering the desired serial number from the ten-key pad 75.

When the file to be reproduced is selected by entering the corresponding serial number of the file from the ten-key pad 75, the designated file is read out from the storage medium of the information storage media unit 37 so that it may be displayed page by page. If the image data consists of double-side information, the image data may be displayed simultaneous on the display unit in two split windows, or sequentially one by one.

Figure 5:
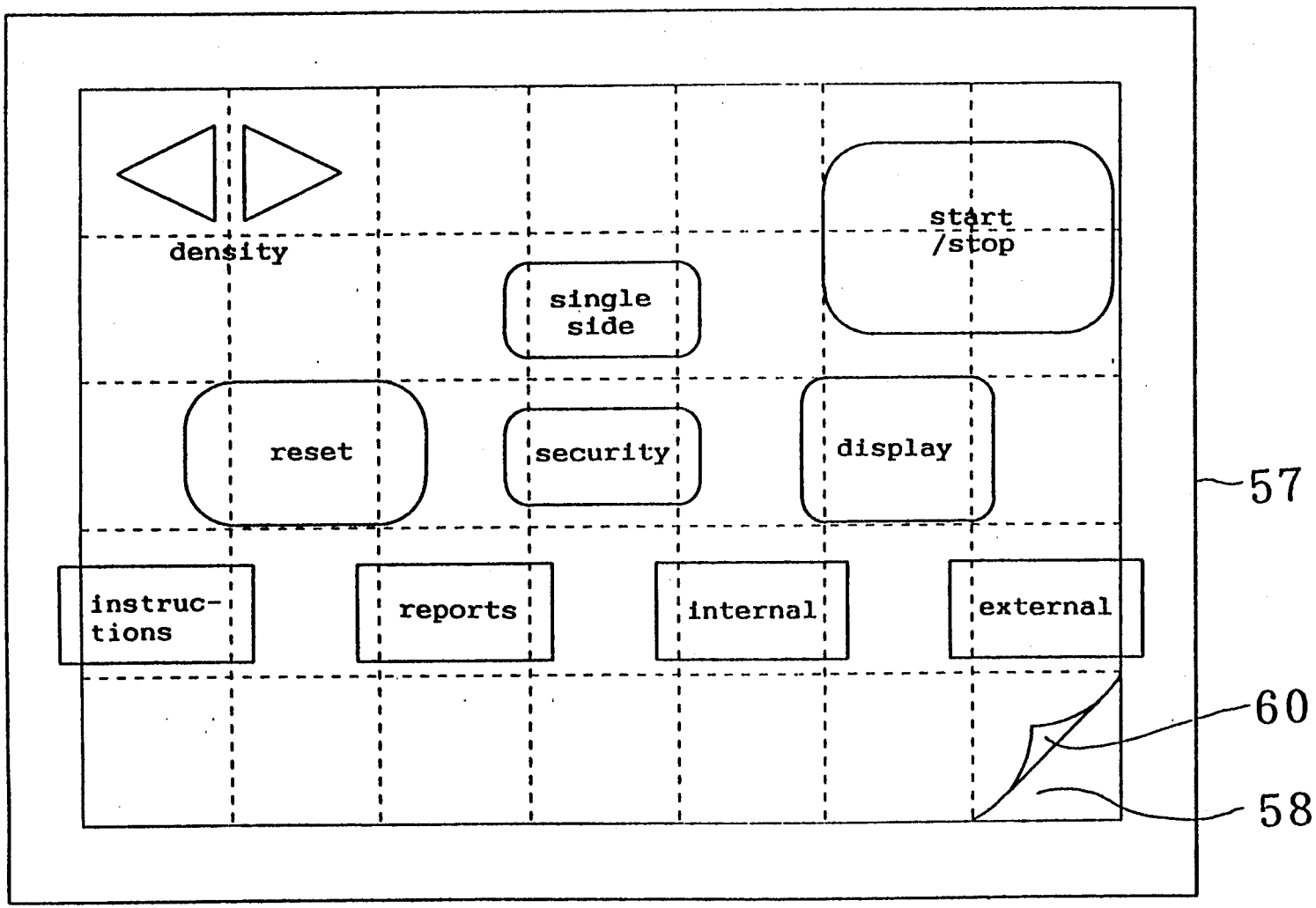
FIG. 5 is a plan view of another embodiment of the display unit for the disposal device according to the present invention.

Referring to FIG. 5, the display unit 57 consists of an LCD panel 58 on which a transparent touch panel 60 is overlaid. According to this embodiment, as illustrated in FIG. 5, various keys are displayed on the LCD panel 58, and various modes, functions and items can be selected by pressing the parts of the touch panel 60 which are indicated as being such keys by the LCD panel 58. In this case, the operation panel 11 may be omitted.

In the disposal device for paper documents illustrated in FIG. 1, the structure of the lower housing B is substantially identical to that of a conventional paper shredder once the upper housing A is removed from the lower housing B, and may be used as a normal paper shredder by using the shredder inlet 10 as the inlet to the paper shredder. The lower housing B may thus consist of an existing paper shredder, and a disposal device for paper documents equivalent to that illustrated in FIG. 1 may be produced simply by mounting the upper housing A on an existing paper shredder.

Figure 6:
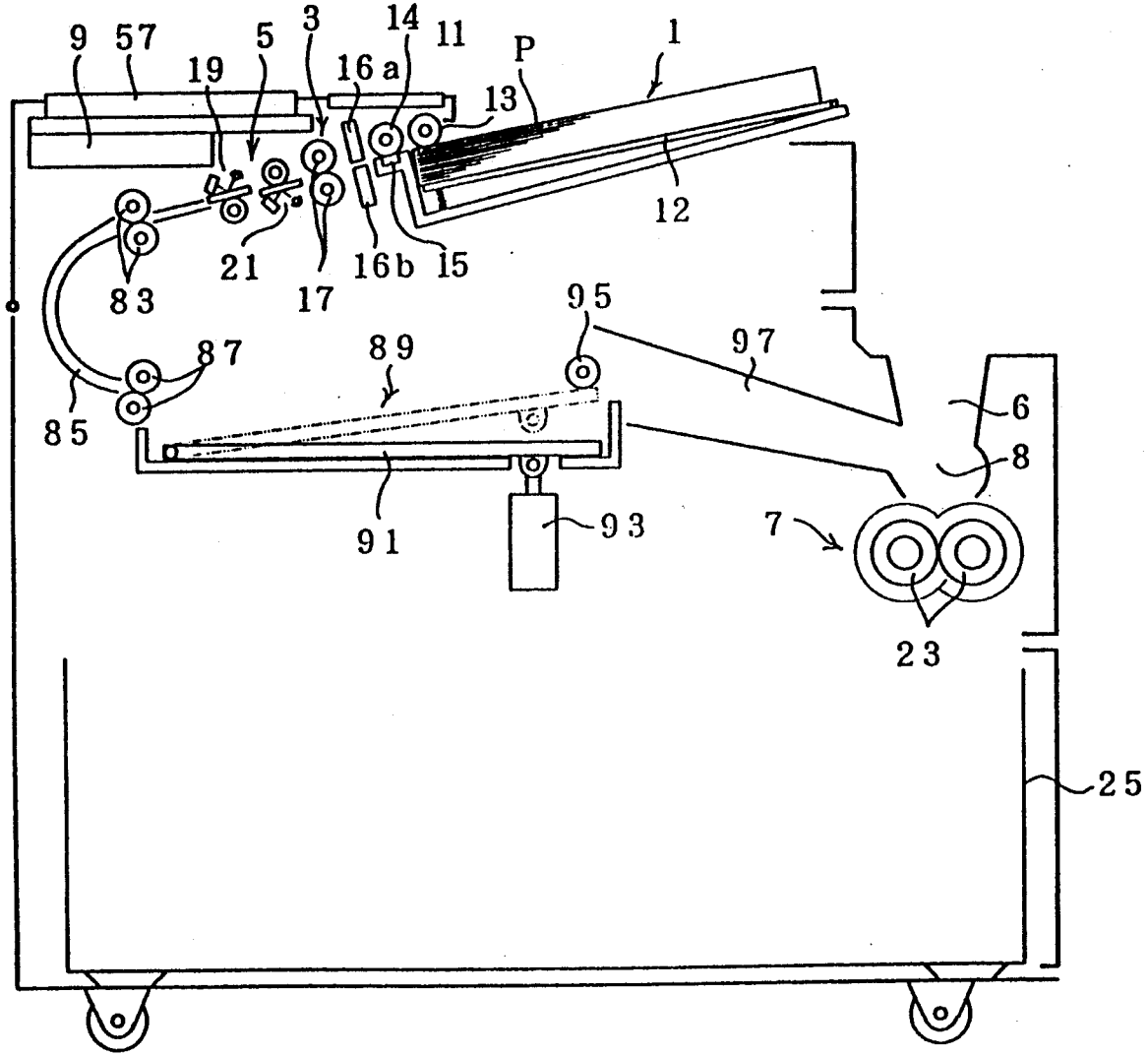
FIG. 6 is a view similar to FIG. 1 showing another embodiment of the present invention.

FIG. 6 shows another embodiment of the disposal device for paper documents. In FIG. 6, like parts to those of FIG. 1 are denoted with like numerals.

In this embodiment, the disposal device for paper documents incorporates a paper storage unit 89 as well as a pair of rollers 83, a paper guide passage 85, and a pair of paper feed rollers 87 for feeding paper sheets P from the information read out unit 5 to the paper storage unit 89. The paper storage unit 89 comprises a movable paper receiving table 91, and actuator 93 for drivingly tilting the paper receiving table 91, and a paper feed out roller 95, and the paper sheets which have passed through the information read out unit are stacked on the paper receiving table 91 which is placed in a lower position as illustrated by solid lines in FIG. 6.

The paper receiving table 91 is brought down to the lower position by the actuator 93 for receiving the paper P and is lifted up to an upper position by the actuator 93 for pushing the paper P on the paper receiving table 91 against the paper feed out roller 95 to feed out the paper sheets P as indicated by the imaginary line in the drawing.

The paper feed roller 95 feeds out the paper P pushed against it toward the paper feed guide passage 97 which is connected to the converging section 8 associated with the manual inlet 6 for guiding the paper P to the converging section 8. The converging section 8 opens into the paper shredding unit 7. The feeding of the paper P to the paper shredding unit 7 by the paper feed out roller 95 may not be necessarily carried out sheet by sheet, but may be carried out for a number of sheets at a time depending on the paper shredding capability of the paper shredding unit 7.

The feeding of the paper P from the paper storage unit 89 to the paper shredding unit 7 may be carried out by pushing an accept key provided in the operation panel 11 or by touching an area of the touch panel 58 in which an accept key is displayed on the LCD panel 58 of the display unit 57. However, this operation is carried out only when the number of sheets of the paper P on the paper feed table 12 which has been checked in advance and the count of the number of sheets of paper that have been read and displayed on the display panel 77 of the operation panel 11 or the display unit 57 agree with each other. Otherwise, feeding of the paper P from the paper storage unit 89 to the paper shredding unit 7 is interrupted, and paper P is taken out from the paper storage unit 89 and returned to the paper feed table 12 as required.

Such a checking process may also be carried out automatically by entering a pre-set number of sheets of paper P on the paper feed table 12 in the information processing unit 9 in advance prior to starting the read out of the paper, and comparing the number of sheets of paper set on the information processing unit 9 with the number of sheets of paper which are automatically counted.

Figure 7:
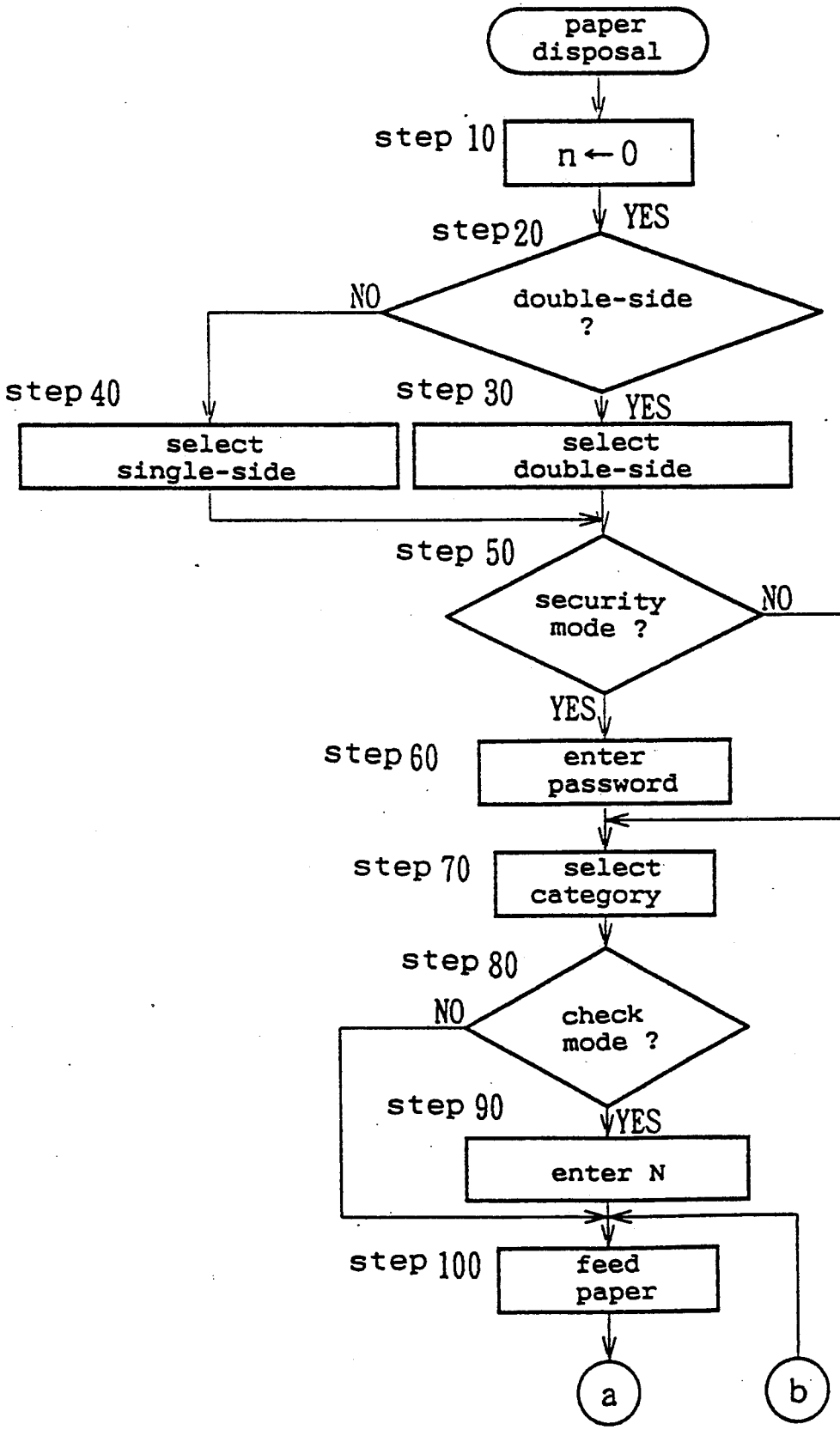
FIG. 7 is a flow chart showing steps 10 through step 100 of the control flow of the embodiment illustrated in FIG. 6.
Figure 8:
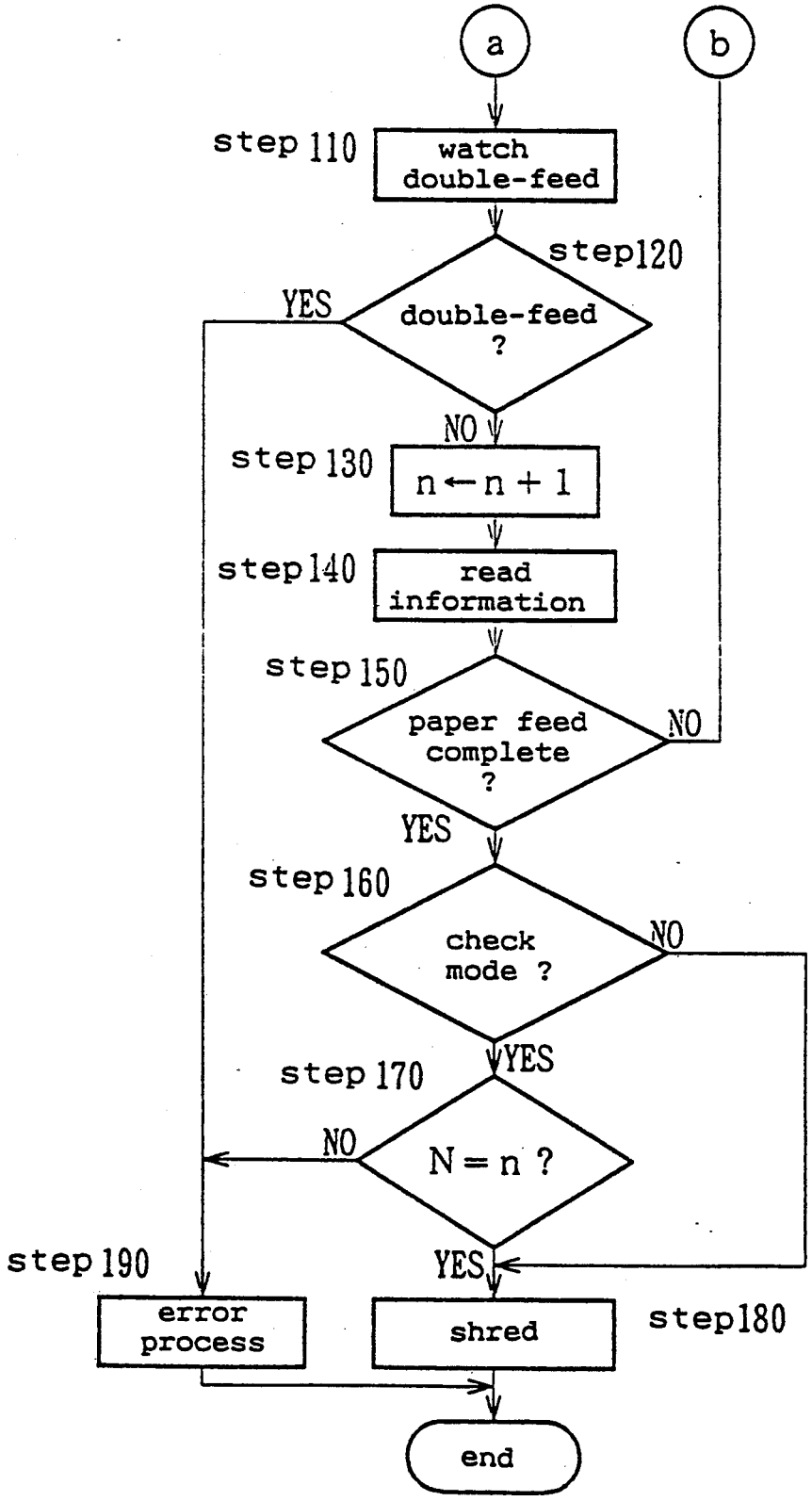
FIG. 8 is a flow chart showing steps 110 through step 190 of the control flow of the embodiment illustrated in FIG. 6.

FIGS. 7 and 8 shown an example of control flow of the disposal device for paper documents equipped with such an automatic checking mode. In this control flow, first of all, the count n of the number of sheets that are to be read is reset (step 10), and it is determined if the current mode is whether the double-side read out mode or the single-side read out mode (step 20) is selected. In the case of the double-side read out mode, the double-side read out mode is set up by activating both the front side CCD line sensor 19 and the back side CCD line sensor 21 (step 30). In the case of the single-side read out mode, the single-side read out mode is set up by activating only the front side CCD line sensor 19 (step 40).

It is then determined if the security mode has been selected (step 50), and, if so, the program flow advances to the step of entering a password (step 60) which is followed by the step of entering an information category (step 70). If the security mode has not been selected, the program flow advances directly to the step of entering an information category (step 70).

Thereafter, it is determined whether the checking mode has been selected and, if so, the number N of sheets of paper P on the paper feed table 12 is inputted (step 90).

When the steps of mode selection are completed, the paper feed action is started (step 100), and the paper P is fed into the information read out unit 5 sheet by sheet while watching for any double paper feed according to the change in the amount of light received by the light receiving element 81 (steps 110 and 120).

When a double paper feed is detected, an error process is carried out and feeding of the paper is interrupted (step 190). If there is no double paper feed, the number n of sheets of paper is counted up by one (step 130), and information is read out from the paper sheet P in the information read out unit 5.

It is determined whether feeding of all the paper P on the paper feed table 12 has been completed or not (step 150), and if there is any paper left on the paper feed table 12 the next paper sheet is fed out (step 100). On the other hand, if all the paper on the paper feed table 12 has been fed out, it is determined whether the check mode has been selected (step 160).

If the check mode has not been selected, the paper in the paper storage unit 89 is immediately conveyed to the paper shredding unit 7 which shred the paper into small pieces (step 180). On the other hand, if the check mode has been selected, it is determined whether the count of the number n of sheets of paper P agrees with the set count of the number N of sheets of paper P or not (step 170).

If the counted number n of sheet of paper P agrees with the set number N, it means that all the paper set on the paper feed table 12 has been fed out sheet by sheet without any double paper feed. In other words, it means that all of the information printed on the paper set on the paper feed table 12 has been read out. Therefore, the feeding out action of the paper storage unit 89 is started, and the paper P in the paper storage unit 89 is fed to the paper shredding unit 7 which shred the paper 7 into small pieces (step 180).

If the count of the number n of sheets of paper P that have been read does not agree with the set number N of sheets of paper P, in particular, if $n<N$, it means that there was double paper feed, and an error process is carried out in which the paper feeding action from the paper storage unit 89 to the paper shredding unit 7 is prohibited (step 190). Thus, shredding and destroying paper P from which information has not been read out can be avoided.

In any one of the above described embodiments, the reproduction of the image data stored in the storage medium of the information storage media unit 37 may be, in addition to being displayed on the display unit, taken out from the disposal device, and transferred to a floppy disk driver or an optical disk driver of a personal computer, an electronic filing system or other information processing device so that the image data stored in the storage medium may be read out with the personal computer or the electronic filing system, and displayed and printed out from the personal computer or the electronic filing system as required. Also, the disposal device may be linked with personal computers and electronic filing systems so that on-line communication may be made therebetween, and the image data may be displayed and printed out from the personal computers and the electronic filing systems as required.

The disposal device for paper documents according to the present invention may consist of two separate units, one containing the automatic paper feed unit 1 and the information read out unit 5 and the other containing the paper shredding unit 7 as indicated by A and B in FIG. 11. In this case, once the unit A containing the paper feed unit 1 and the information read out unit 5 is removed from the unit B containing the paper shredding unit 7, the unit B may simply consist of a conventional paper shredder, and may also be used as a normal paper shredder. The unit B may also consist of an existing paper shredder, and it may be converted into a disposal device for paper documents according to the present invention simply by mounting the unit A as described above on the existing paper shredder.

In the above described embodiments, CCD line sensors were used as means for information read out, but the present invention is not limited to the use of such CCD sensors but may use contact-type CCD sensors or other optical reader systems.

As described above, in the disposal device for paper documents according to the present invention, since the feeding of paper that is to be disposed can be done either with automatic feeding means or manually, the disposal of sensitive paper documents can be carried out sheet by sheet by placing the paper on the automatic paper feed means while paper documents which do not require any security measures may be manually fed into the disposal device for an immediate shredding process. Therefore, the present invention allows both appropriate and efficient disposal of paper documents without regard to whether the paper documents to be disposed required security measures or not.

Although the present invention has been described in terms of preferred embodiments thereof, it is obvious to a person skilled in the art that various alterations and modifications are possible without departing from the scope of the present invention which is set forth in the appended claims.

What we claim is:

1. A device for disposing paper and other information carrying media, comprising:

means for feeding paper individually for each sheet;

information read out means for reading information carried by each sheet of paper fed by said paper feeding means;

information storage means for storing said information obtained by said information read out means so as to be reproduced as required;

paper shredding means for shredding said paper after said information is read there from; and a manual inlet for feeding paper directly into said paper shredding means.

2. A device according to claim 1, wherein said paper shredding means consists of an existing paper shredder.

* * * * *